US006415847B1

(12) United States Patent
Baltz et al.

(10) Patent No.: US 6,415,847 B1
(45) Date of Patent: Jul. 9, 2002

(54) CRANKSHAFT CASTING PATTERN AND METHOD

(75) Inventors: Gene Frederic Baltz, Olmsted Falls; Jerome John Grzincic, Medina; Ronald John Nakoneczny, Olmsted; Thomas Eugene Sattler, Medina, all of OH (US)

(73) Assignee: Ford Global Tech, Inc., Dearborn, MI (US)

( * ) Notice: Subject to any disclaimer, the term of this patent is extended or adjusted under 35 U.S.C. 154(b) by 0 days.

(21) Appl. No.: 09/660,508

(22) Filed: Sep. 12, 2000

(51) Int. Cl.[7] ..... B22C 7/00
(52) U.S. Cl. ..... 164/235; 164/236; 164/249
(58) Field of Search ..... 164/15, 29, 45, 164/235, 236, 516, 249; 29/888.08

(56) References Cited

U.S. PATENT DOCUMENTS 3,830,285 A * 8/1974 Schrader, Jr. ..... 164/249
4,015,654 A * 4/1977 Witchell ..... 164/4.1
4,078,598 A * 3/1978 Kelso et al. ..... 164/30
4,283,835 A * 8/1981 Obrochta et al. ..... 29/527.6
4,641,702 A * 2/1987 Petrenchik ..... 164/137
4,794,975 A * 1/1989 Volkmann ..... 164/29
5,111,569 A * 5/1992 Ostergaard ..... 29/407.05
6,116,327 A * 9/2000 Beighton ..... 164/45

* cited by examiner

*Primary Examiner*—M. Alexandra Elve
*Assistant Examiner*—Kevin P. Kerns
(74) *Attorney, Agent, or Firm*—Ford Global Tech, Inc.

(57) ABSTRACT

A crankshaft casting pattern insert 10 which includes selectively adjustable portions 14, 16, which respectively correspond the front and rear main bearing journal portions of the crankshaft. Each adjustable portion 14, 16 includes a removable insert or member 18, a key member 20, several "vertical" spacers 22, several "lateral" spacers 24, and a fastener 26. Adjustable portions 14, 16 allow the pattern 10 to be selectively modified in shape, effective to compensate for pattern wear and to allow multiple crankshafts to be produced which have a substantially similar balance capability. Pattern 10 may also include several validation pads or points 50 which allow the produced crankshafts to be measured with improved accuracy.

12 Claims, 5 Drawing Sheets

CRANKSHAFT CASTING PATTERN AND METHOD

(1). FIELD OF THE INVENTION

This invention relates to a crankshaft casting pattern and method and more particularly, to a crankshaft casting pattern and method that produces crankshafts which have an improved rotational balance capability and which can be measured with improved accuracy.

(2). BACKGROUND

Engine crankshafts are typically formed by use of a casting procedure or methodology. One type of casting process, commonly referred to as a "green-sand foundry" process, utilizes an upper pattern shape of the desired crankshaft called a "cope pattern" and a lower pattern shape of the desired crankshaft called a "drag pattern". During the green sand foundry process, the pattern shape is impacted into a "green-sand" flask, thereby leaving an imprint in the sand corresponding to the desired casting shape. The upper cope pattern forms the upper half of the part and the lower drag pattern forms the lower half of the part.

When crankshafts are produced through the green-sand process, several casting shapes or pattern inserts are mounted on a plate to produce multiple parts in the molding process (e.g., two, four, six, eight or more parts may be made simultaneously). Making multiple parts in one mold improves production efficiency. The desired shape of the finished casting is a function of the shape of the pattern insert, the quality properties of the mold sand, the alignment of the upper mold half (i.e. the cope portion) to lower mold half (i.e. the drag portion), and the shrink rate of the molten metal as it cools.

The metal used to form the crankshafts is typically a high nodularity (or ductile) type iron. The nature of making green-sand high nodularity cast-iron crankshafts requires that the mold sand properties be dimensionally consistent across the entire mold so that all cast parts have the same desired dimensional consistency. Also, the pattern inserts must be dimensionally consistent from insert to insert so that the cast parts have the same desired dimensional consistency. The alignment accuracy of setting the cope mold flask onto the drag mold flask has a great influence on the dimensional consistency of the cast part.

One of the most influential characteristics of the green-sand high nodular cast-iron foundry process is the solidification nature of the molten iron, as nodular iron has a great tendency to swell during solidification. This swell tendency causes the iron to push outward on the mold sand resulting in mold deformation. If mold deformation during solidification is constant across the entire mold sand shape, then all crankshaft castings will have the same dimensional consistency. However, if mold sand deformation during solidification is not constant across the entire mold, then the dimensions of the castings will have slight variations. These slight variations cause the produced crankshafts to have varying shapes from insert to insert, which leads to changes in the mass properties of the crankshafts which ultimately causes variations in the production mass balancing process.

Pattern inserts that are positioned at the outer edges of the flask have mold sand properties different from the pattern inserts that are positioned at the inside of the flask. As a result, mold sand deformation varies across the mold, allowing for cast parts at the inside of the mold to have slight dimensional differences from cast parts at the outer edge of the mold. This is due to density differences in mold sand.

The varying densities cause the mold sand to react differently to iron solidification at different locations within the mold. Because the various crankshaft castings produced by the mold have slight dimensional variations due to their respective positions in the mold, the crankshafts will have slightly different mass properties which influence the ability to balance the crankshaft in a repeatable process.

Particularly, because the crankshaft castings vary slightly in dimensional properties, the mass balance properties will have a similar variation in the machining/balancing process of manufacturing. With variations in the casting process, it becomes necessary to sort castings by insert or pattern number and then machine and balance as a given insert number. This requires sorting (e.g., batching) castings by their respective insert or pattern number and then processing by insert number through the machining and balancing process. This sorting and running by insert number requires that the machine centering operation be adjusted accordingly to insure proper mass balance capability of the finished crankshaft. Thus, every crankshaft insert may require a different machine centering set-up to process, which substantially increases production cost and reduces efficiency.

The unique nature of the machining and balancing process causes these problems. Particularly, when a crankshaft rough casting is delivered to the machining station, the first operation of machining is to add the rotational center drill operation at each end of the crankshaft. After the centering operation, all machining features are sequentially completed from these centers which is the main machining feature datum. This machined centering datum is required to be on the near exact center of the rough casting in order to ensure proper mass balancing at the last machining operation. Thus to ensure that the machined part is balanceable, the casting mass center must be within the mass center of the machining operation. Any slight differences are compensated for by the balancing operation which drills away material at the end counter-weights to bring the part within mass-balance specification. However, any variation in casting features may result in a crankshaft that is not balanceable due to the mass properties which are out of the range of balancing equipment capabilities.

To insure that the rough casting datums are within the machined center datums, there requires a critical interface between casting datums and machining datums. This is accomplished by using the end main bearing journals which are clamped into centering jaws of the machine which adds the crankshaft centers. FIG. 6 illustrates the machine clamping jaw configuration at the crankshaft centering operation.

FIGS. 6*a*–6*c* illustrate the effect of size variation on the location of the journal when clamped by the centering members or clamps 90, as well as an incoming casting size variation which results from pattern separation at the parting line of the mold. Mismatch of the mold causes an offset in the part which can effect the clamping jaws 90 which locate the machine centering datum or centerline. Journal roundness can also effect the centering members which can influence the centering operation of the crankshaft.

Thus, in order to have a correctly centered machining operation, it is essential to have a casting shape which is correct in diameter roundness, parting-line separation and mold mismatch to minimize dimensional variation.

There is therefore a need for a crankshaft casting pattern and methodology which produces rough crankshaft castings which are substantially similar in shape and size, thereby allowing all of the castings to be processed with one machine centering operation to ensure consistent mass balance with no variation.

SUMMARY OF THE INVENTION

It is a first object of the invention to provide a crankshaft casting pattern and method which overcomes some or all of the previously delineated drawbacks of prior crankshaft casting patterns, systems and methods.

It is a second object of the invention to provide a crankshaft casting pattern having a modifiable pattern shape which allows rough crankshaft castings to be altered, thereby improving their rotational balance capabilities.

It is a third object of the invention to provide a crankshaft casting pattern having a selectively modifiable pattern shape which produces crankshafts which require a reduced amount of drilling during balancing.

It is a fourth object of the invention to provide a crankshaft casting pattern and method which produces crankshafts which are substantially similar in shape and size throughout a mold, thereby substantially eliminating and/or reducing the need to sort castings prior to balancing.

It is a fifth object of the invention to provide a crankshaft casting pattern and method which allows critical dimensional features of a produced crankshaft to be accurately measured.

It is a sixth object of the invention to provide a crankshaft casting pattern which is selectively adjustable to compensate for pattern wear over time.

According to a first aspect of the present invention, a casting pattern is provided and includes at least one selectively adjustable portion, which allows said casting pattern to be selectively modified in shape.

According to a second aspect of the present invention, a method is provided for casting components. The method includes the steps of providing a plate having a plurality of adjustable pattern inserts; forming a plurality of molds by use of the plurality of pattern inserts; making a plurality of sample castings by use of the plurality of molds; dimensionally analyzing the plurality of sample castings; and adjusting the plurality of pattern inserts based upon the dimensional analysis, effective to ensure that all castings that are made from molds formed by the plate have substantially similar balance characteristics.

These and other objects, aspects, features, and advantages of the present invention will become apparent from a consideration of the following specification and the attached drawings.

DETAILED DESCRIPTION OF THE PREFERRED EMBODIMENT OF THE INVENTION

Figure 1:
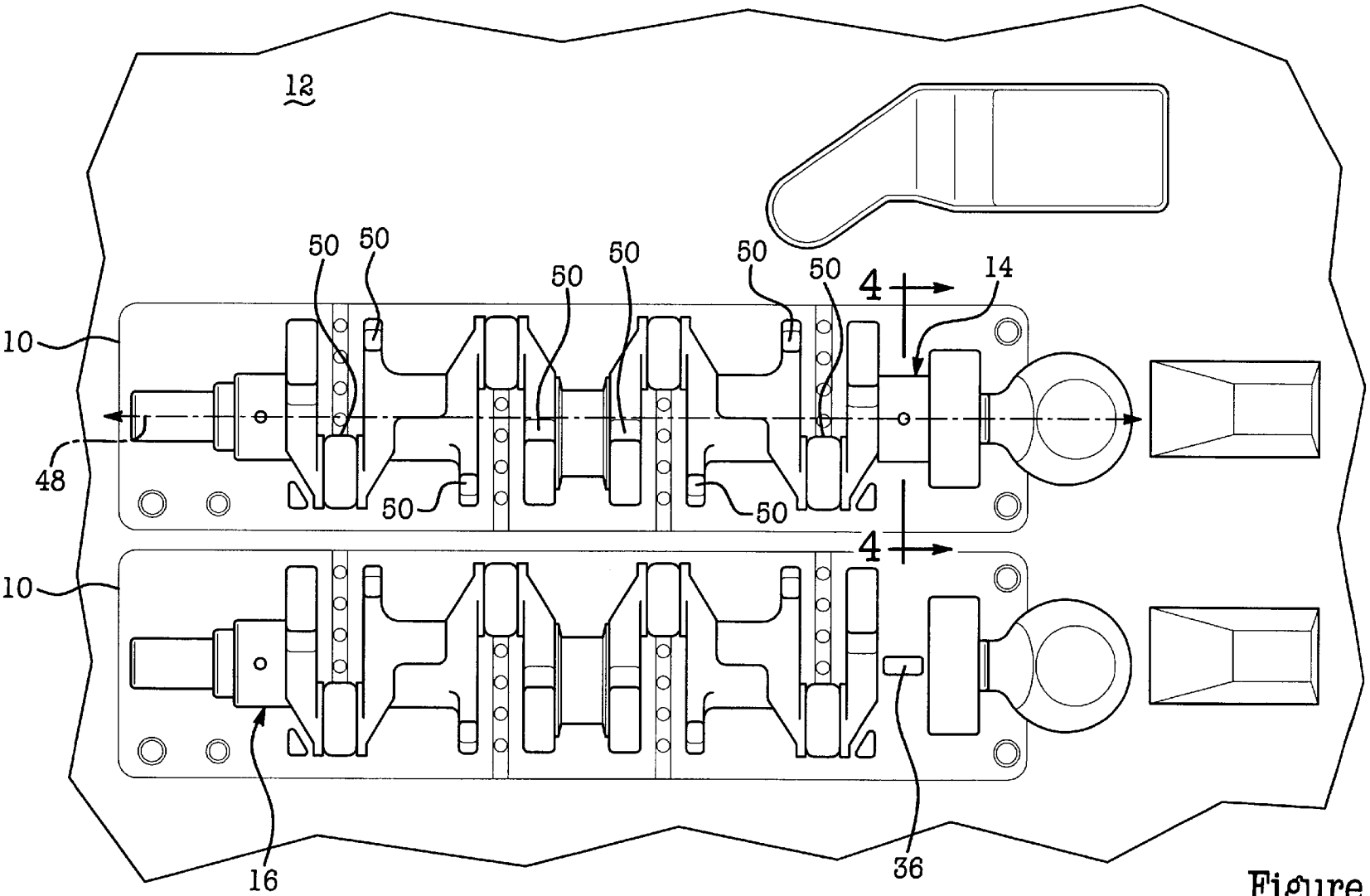
FIG. 1 is a top view of a portion of a crankshaft casting pattern which is made in accordance with the teachings of the preferred embodiment of the invention.

Referring now to FIG. 1, there is shown a pair of crankshaft casting pattern inserts 10 which are made in accordance with the teachings of the preferred embodiment of the invention. It should be appreciated each pattern 10 comprises one half or portion (i.e., a "drag" or "cope" pattern or portion) of a complete crankshaft pattern. The pattern inserts 10 are substantially identical and are mounted on a plate or member 12 which includes several other inserts (not shown) which are used to form multiple crankshafts during the molding process (e.g., four, six, eight or more crankshafts).

In the preferred embodiment of the invention, patterns 10 are substantially identical in shape and size and are formed from a strong, rigid and durable material suitable for use in a "green-sand" type foundry process, such as aluminum or steel. These patterns are manufactured with a relatively high dimensional accuracy with each insert 10 being nearly identical to the insert 10 next to it, thereby providing for the formation of sand molds that produce finished parts that require only a minimal amount of machining operation and final mass balancing operation.

Figure 5:
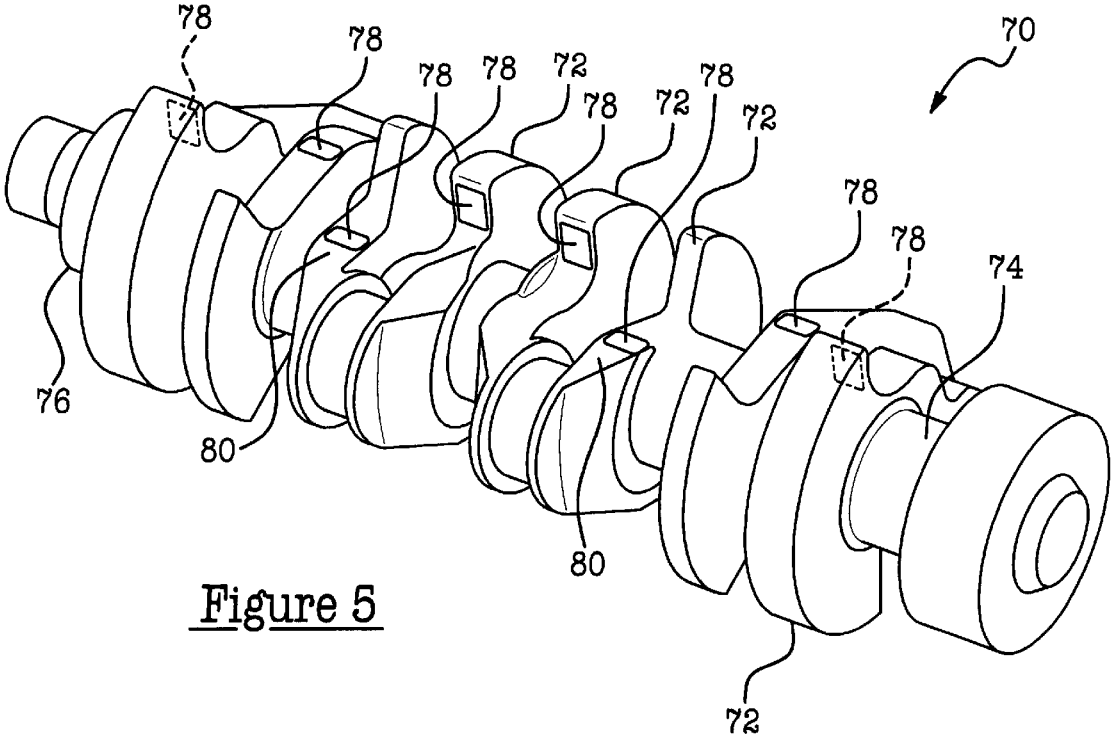
FIG. 5 is a perspective view of a crankshaft which is produced using the crankshaft casting pattern shown in FIG. 1.
Figure 6A:
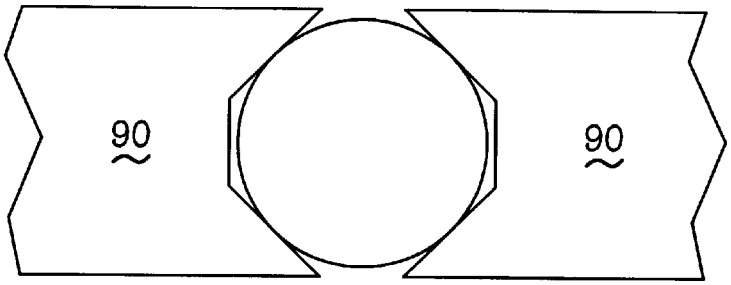
FIGS. 6*a*–6*c* are cut-away views of various crankshafts which are clamped by centering members of a machining device and illustrating the effect of variations in the shape of crankshafts on the centering operation.
Figure 6B:
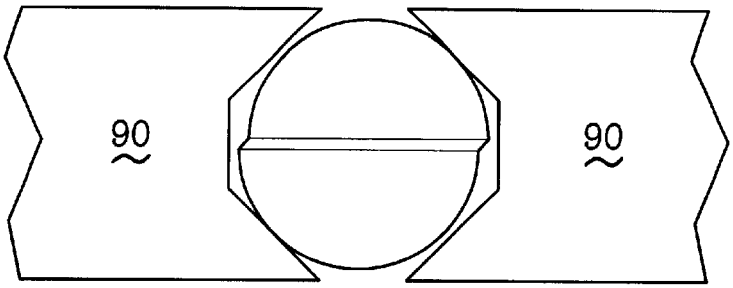
Figure 6C:
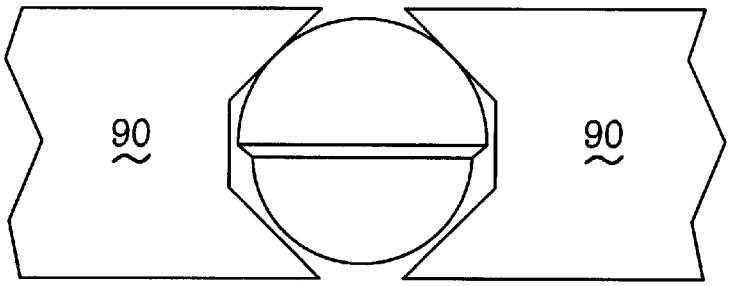

An example of a crankshaft 70 which may be selectively cast or formed using the inserts 10 is illustrated in FIG. 5. Crankshaft 70 includes several counterweights 72, a front main bearing journal 76 and a rear main bearing journal 74.

Figure 2:
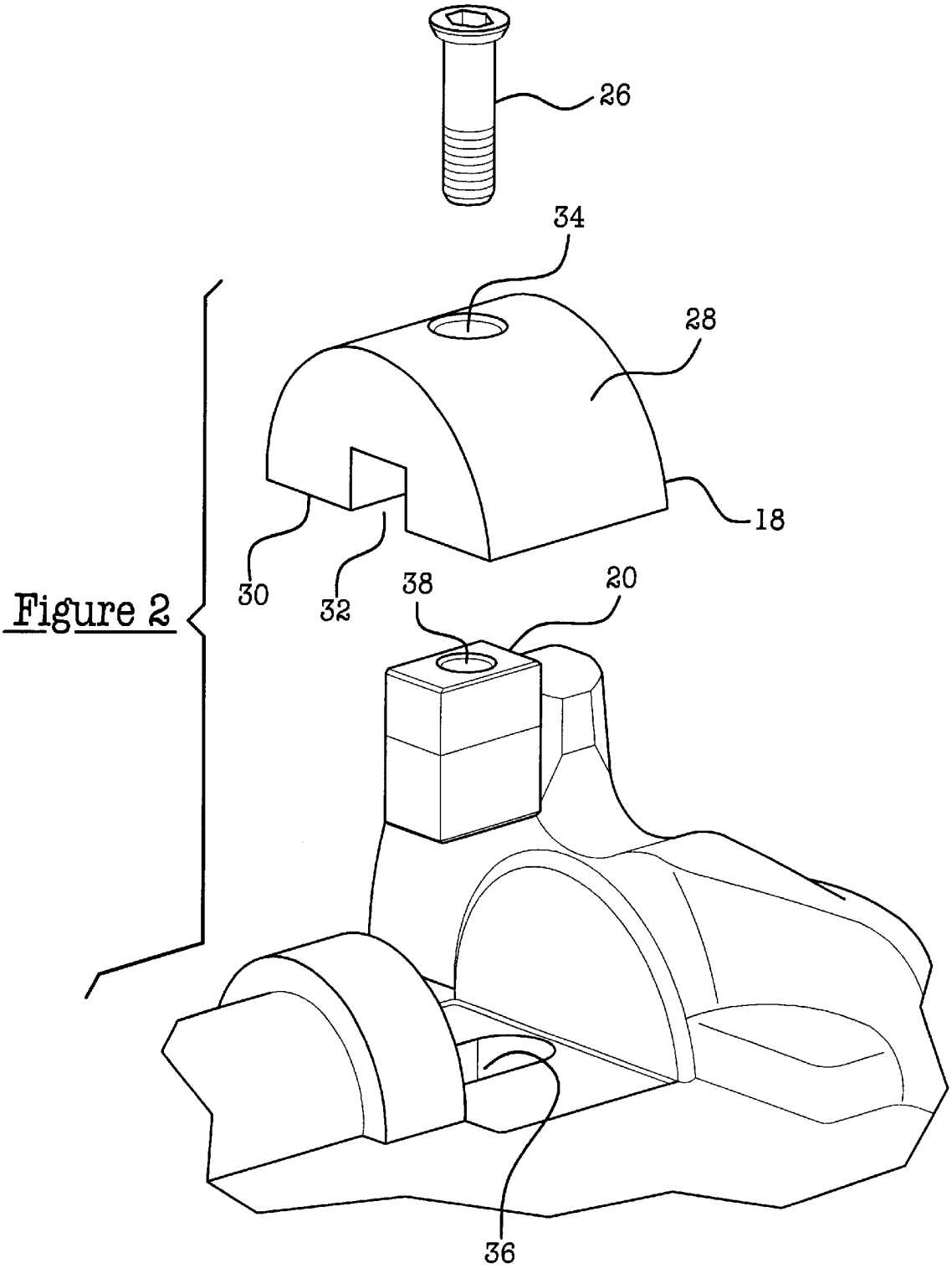
FIG. 2 is an exploded, partial perspective view of the crankshaft casting pattern shown in FIG. 1 which illustrates the insert and key portion removed from the crankshaft casting pattern.
Figure 3:
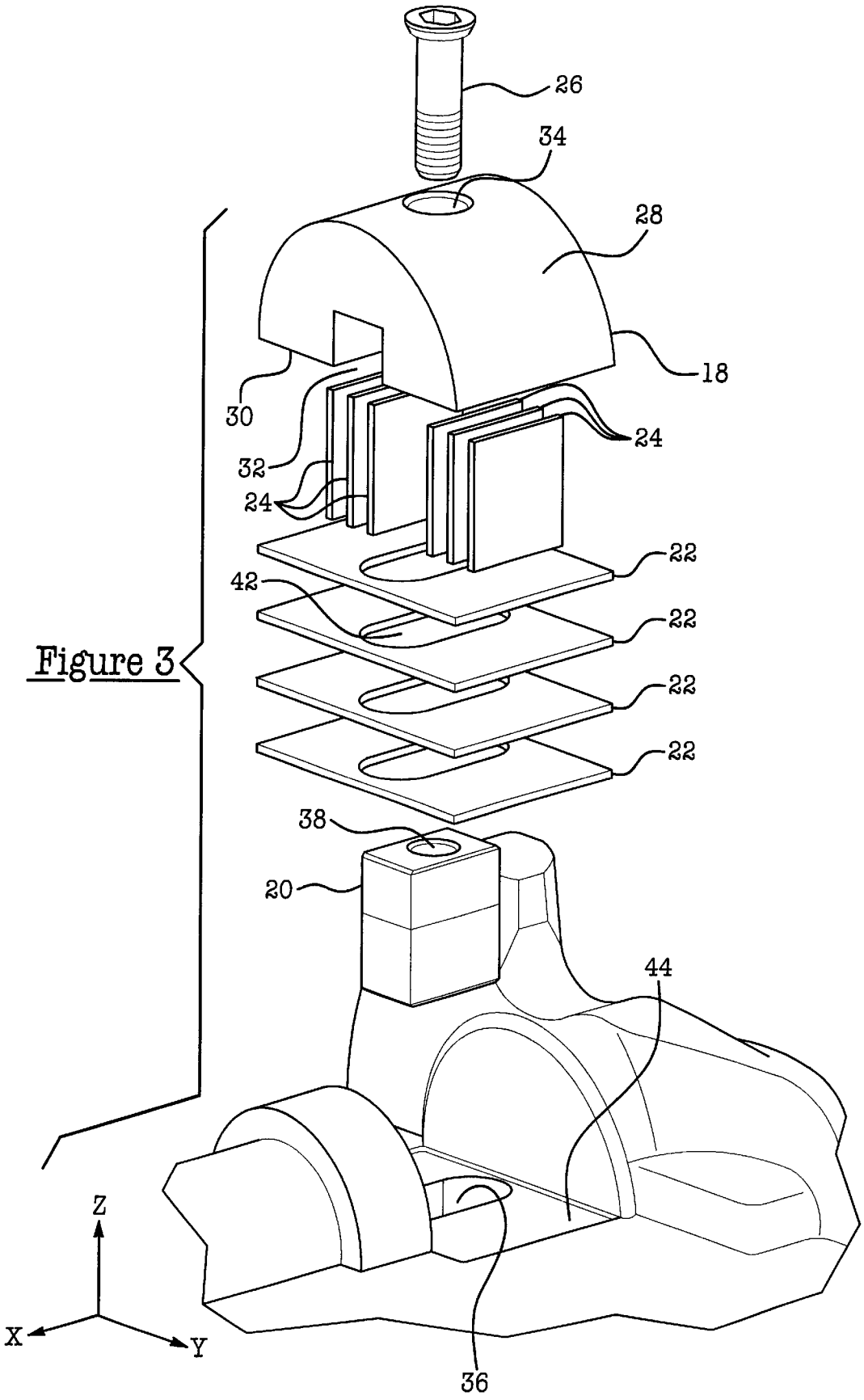
FIG. 3 is an exploded partial perspective view of the crankshaft casting pattern shown in FIG. 1 which illustrates the insert, key portion, and several spacers that are used to adjust the position of the insert.
Figure 4:
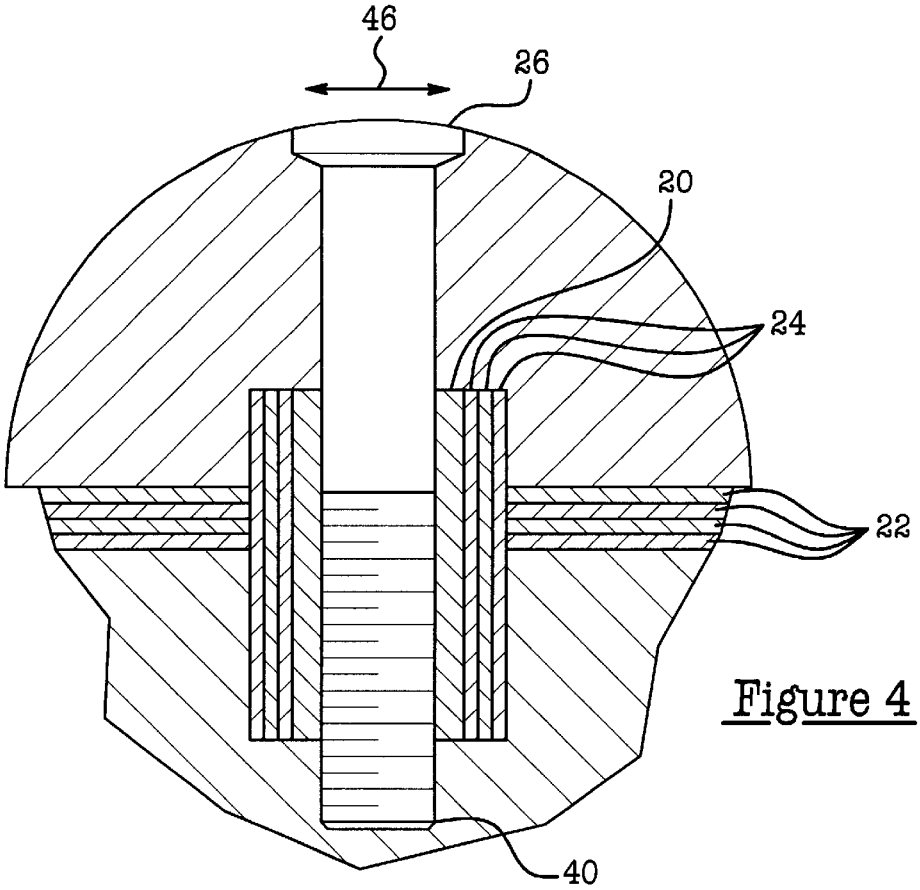
FIG. 4 is a cross-sectional view of the crankshaft casting pattern shown in FIG. 1 and taken along view line 4—4.

The pattern inserts 10 each include selectively adjustable portions 14, 16, which respectively correspond the rear and front main bearing journal portions 74, 76 of the crankshaft 70. As shown best in FIGS. 2–4, each adjustable portion 14, 16 includes a removable insert or member 18, a key member 20, several "vertical" or "Z"-axis shim members or spacers 22, several lateral shims or "Y"-axis shim members or spacers 24, and a fastener 26. Removable inserts 18 are generally semi-cylindrical in shape and include a smooth outer surface 28, which substantially conforms to the outer surface of the main bearing journals 74, 76. Inserts 18 further include a generally flat bottom surface 30 having a generally rectangular channel or slot 32 that selectively mates with key member 20 and spacers 24 (as shown best in FIG. 4), and an aperture or channel 34 which selectively receives fastener 26.

The key member 20 is generally rectangular and is shaped to be selectively inserted into a generally oval slot 36 which is formed within the insert 10 and/or plate 12 and which is located directly beneath the adjustable bearing insert 18. Key member 20 includes an aperture or channel 38 which may be aligned with an aperture 40 formed within pattern 10, and receive the conventional bolt-type fastener 26, thereby allowing insert 18 and key 20 to be selectively secured to the pattern 10.

Vertical spacers 22 are generally rectangular in shape and include a generally oval aperture 42 which is of substantially the same shape as slot 36. Spacers 22 are selectively inserted between the bottom surface 30 of insert 18 and the surface or base 44 of pattern 10. Lateral spacers 24 are substantially rectangular and may be selectively inserted on either or both sides of key member 20 as shown best in FIG. 4. In the preferred embodiment of the invention, spacers 22, 24 are manufactured from the same material as patterns 10. Spacers 22, 24 are relatively thin and in one non-limiting embodiment, spacers 22, 24 may each have a different thickness.

Components 18, 20, 22, 24 and 26 are manufactured with relatively close or "tight" tolerances and are secured in a relatively tight manner (e.g., by use of fastener 26), so that the adjustable parts do not move under the force of the sand molding impact process. In the preferred embodiment, a soft metal or brass is inserted into apertures 34 after the fasteners 26 are bolted down, thereby forming a continuous smooth surface 18 which will form the interior surface of the sand mold.

In operation, through accurate dimensional measurements, the adjustable main journal portions 14, 16 begin with the first sample castings with the journals inserts 18 directly "on center" (e.g., equal number of spacers 24 are inserted on each side of key 20, and an equal number of spacers 22 are used on the cope and drag pattern inserts 10). Molds are formed using plate 12 and sample castings are made and are then accurately configured on a digital coordinate measuring machine to determine the main journal centers and all the counterweight dimensional features. With this data analysis, it is determined where the adjustable main bearing journals 14, 16 at the front and rear of the crankshaft pattern need to be dimensionally moved (e.g., in order to ensure substantially similar balance characteristics and capabilities for all the molds formed by plate 12). The pattern inserts 10 are then accordingly adjusted by use of spacers 22, 24 and adjustable inserts 18.

Particularly, the main bearing journals 14, 16 may be slightly lowered or raised relative to the pattern base 10. It should be appreciated that if the cope portion of the pattern is to be raised, the drag portion of the pattern should be correspondingly lowered, and vice versa. To provide dimensional movement in the "plus z" direction, spacers 22 are selectively positioned between the pattern base (i.e., surface 44) and the main bearing inserts 18. The number and/or thickness of spacers 22 used are based upon the magnitude of the desired positional adjustment of journals 74, 76. The number and thickness of spacers 22 determine the height of the main bearing insert relative to the base 44 of the pattern and would selectively afford a position in the "plus z" direction to provide the needed off-set of the adjustable main bearing journal 14, 16 for the correct height setting. This height setting is determined from dimensional data analyzed from a digital coordinate measuring machine. In the preferred embodiment of the invention, the other half of the pattern (i.e., the cope or drag portion) would be lowered by a similar amount by removing spacers 22, thereby moving insert 18 in the "minus z" direction.

The inserts 18 may also be selectively adjusted in the "y-axis" or lateral direction by use of spacers 24. Particularly, spacers 24 may be removed from one side of the key member 20 and placed on the other side of the key member 20 to achieve a desired amount of lateral dimensional movement (e.g., movement in the directions of arrows 46). The number of spacers 24 moved from one side to the other side of key member 20 may be determined from data analyzed from the digital coordinate measuring machine.

After the spacers 24 are placed on one side of the key member 20 for the desired "y-axis" off-set and the spacers 22 are placed between the main bearing insert and the pattern base 44 for the desired "z-axis" offset, the inserts 18 are secured in place with fasteners 26. Fastener 26 is then preferably covered with a brass material or plug. The brass insert plug is press-fit over the locking bolt and "hand benched" to blend the contour of the brass to match the contour of the outer surface 28 of the bearing journal insert 18. This brass insert is contoured to meet the roundness criteria of the bearing journal 74, 76 of the crankshaft with reasonable dimensional accuracy. However, the brass plug contour, if not perfect, will not interfere with the machining operation chucking jaws, as the position of the brass plug is selected to be out of location of the clamping jaws at the centering operation.

After applying the adjustment to both the cope and drag patterns, the parts formed and cast with the present invention will contain a revised centering datum that shifts the casting centerline datum to a desired dimension. The casting centerline shift represents a machining centerline that allows the rotation mass to fall at a desired location, resulting in an improvement in balance. All of the pattern inserts 10 are adjusted so one mass balance centerline is achieved, thereby allowing the machining centerline datum set-up to remain fixed at one setting for all of the produced crankshaft castings. That is, each pattern 10 is shifted or altered so that one machining set-up allows all inserts to fall within a desired balance window.

Another advantage of the present invention is that the pattern equipment is adjustable as the pattern inserts 10 wear over time. Each pattern 10 experiences repeated impacts during the green-sand molding process. The green-sand molding process is abrasive to the pattern equipment and thus slowly "wears down" the patterns 10 with each cycle. As the patterns 10 wear, the dimensional features of the resulting crankshafts 70 change (e.g., the patterns 10 wear smaller so the actual parts produced become smaller). As the resulting crankshaft size changes gradually over time, the mass balance properties also change. Thus, the present invention allows for a periodic review of the wear properties that effect balance, and a corresponding alteration or revision of the pattern inserts 10 (e.g., by selectively shimming inserts 18). In this manner, the resulting crankshafts can be periodically adjusted so that they continue to comply with the desired dimensional and mass balance characteristics.

In one non-limiting embodiment, pattern inserts 10 include several integrally formed "zero-tolerance" validation pads, indicators or points 50 which are selectively applied to, formed upon and/or machined into the pattern inserts 10 and which are subsequently transferred to the actual castings 70 as points 78. Validation pads 50 are added to the pattern inserts at selected surfaces that remain unmachined or "as-cast" during the crankshaft machining and balancing process. In the preferred embodiment, the validation pads or points 50 are accurately cut or machined into the pattern inserts 10 at prescribed locations. These validation pads 50 are machined into the pattern inserts 10 with nearly zero tolerance and are defined to lay within a perfect plane relative to the exact centerline or axis 48 of the pattern insert 10.

As shown in FIG. 5, the indicators or pads 50 are correspondingly transferred to the formed crankshaft 70, thereby forming validation points 78. In the preferred embodiment, a total of sixteen validation points 78 are transferred from the zero-tolerance validation points or pads 50 of the pattern. Eight validation points 50 are formed on the "cope" side of crankshaft pattern and eight validation points 50 are on the "drag" side of the crankshaft pattern. Four of the eight validation pads are located on the edge of the counterweights 72 and four of eight validation pads are located on the "cheek" portions 80 of the crank-pins. This arrangement is applied to both the cope side and drag side of the crankshaft pattern. The fact that the four pads or points 78 on the counterweights 72 lay in a perfect planar configuration about the centerline 48 of the pattern, the four pads 78 are also planar relative to the casting centerline. Moreover the fact that the four pads or points 78 on the cheek portions

80 lay in a perfect planar configuration about the centerline 48 of the pattern, the four pads 78 are also planar relative to the casting centerline. This is true with respect to both the cope side and drag side of the crankshaft casting 70. This relationship may be used to validate the dimensions of the produced crankshafts.

For example and without limitation, the machining centerline of the casting, as defined by the clamping jaws of the machine center-drilling equipment, can be used as an inferred centerline for setting up the casting 70 on a dimensional coordinate measuring machine. The coordinate measuring machine can fittingly touch the casting 70 at the main journals 74, 76 while also touching the validation points 78 to determine secondary planar features in order to acquire accurate dimensional data of the casting 70. The relationship of the machining centerline to secondary centerlines, which may be established from the validation points 78, provides for more accurate measurements of the casting 70 before and after machining.

The validation pads 50, 78 also allow for accurate measurement of the part 70 in order to determine cope-to-drag mold shift (caused by mold parting); cope-to-drag mismatch (caused by pattern insert misalignment); bend or bow of the crankshaft 70 during metal solidification; and comparison of the machining centerline to the casting contour surface features of all other surfaces of the part relative to the casting centerline. The validation pads 50, 78 also allow for improved measurement capabilities that are required to accurately determine the correct "shimming" of the adjustable inserts 18 of the crankshaft pattern 10 for improved mass balancing capabilities.

For accurate determination of mass balance capabilities, the validation pads 50, 78 allow the crankshaft to be measured with improved accuracy. Multiple points can be taken along all surface feature contours of the casting which are accurate about the casting centerline. Counterweight surface contours can be measured as a multiple set of data features and can be related to the centerline of the counterweight relative to the centerline of the crankshaft. By knowing all the centerlines of the cast profile features relative to the manufacturing machining centerlines, it becomes possible to predict mass centers of the parts for improved balance capabilities. This is not possible with other casting methods and patterns unless an accurate centerline of the casting is dimensionally definable.

It has been demonstrated through experimentation, that crankshaft pattern inserts fittingly applied with validation pads, can produce castings with enough accuracy to use a dimensional coordinate measuring machine to determine the correct mass center of the part with resultant near perfect mass balance capability. These castings were measured accurately and the correct centerline was machined to this centerline. Experimentation determines that this centerline will provide accurate balance capability as a rough casting (i.e., an unmachined casting). Thus, a rough casting measured and defined with a centerline will prove capable of meeting the same mass balance capability of a machined casting. Thus, the validation pads 50, 78 of the present invention become tools for allowing a dimensional coordinate measuring machine to accurately predict mass balance capabilities.

It is understood that the invention is not limited by the exact construction or method illustrated and described above but that various changes and/or modifications may be made without departing from the spirit and/or the scope of Applicants' inventions.

What is claimed is:

1. A crankshaft casting pattern comprising at least one selectively adjustable portion which allows said casting pattern to be selectively modified in shape, and to produce certain castings, wherein said crankshaft pattern comprises a plurality of validation pads which correspond to unmachined portions of said castings, and wherein said validation pads are integrally formed within said casting pattern and are each disposed within a first plane.

2. The casting pattern of claim 1 wherein said at least one adjustable portion comprises a removable insert.

3. The casting pattern of claim 2 wherein said casting pattern is disposed on a plate, and wherein at least one adjustable portion further comprises a key member which selectively engages said plate and said removable insert.

4. The casting pattern of claim 3 wherein said at least one adjustable portion further comprises at least one first spacer which is selectively and operatively disposed between said removable insert and said plate.

5. The casting pattern of claim 3 wherein said at least one adjustable portion further comprises at least one second spacer which is selectively and operatively disposed between said removable insert and said key member.

6. A casting pattern for forming a crankshaft, said casting pattern comprising:

a base portion having a cavity;

a key member which is disposed within said cavity;

an adjustable member which is selectively attached to said base and having a channel which receives said key member;

a plurality of vertical spacers which are selectively insertable between said base and said adjustable member, effective to selectively and vertically alter the position of said adjustable member relative to said base; and a plurality of lateral spacers which are selectively insertable within said cavity and said channel between said key member and said adjustable member, effective to selectively and laterally alter the position of said adjustable member relative to said base.

7. The casting pattern of claim 6 wherein said adjustable member corresponds to a main bearing journal of said crankshaft.

8. The casting pattern of claim 6 further comprising a fastener which engages said key member, said adjustable member and said base, thereby securing said key member and said adjustable member to said base.

9. The casting pattern of claim 8 wherein said adjustable member includes an aperture which receives said fastener, said casting pattern further comprising a plug which is selectively insertable into said aperture after said fastener has securing said key member and said adjustable member to said base.

10. The casting pattern of claim 9 wherein said plug is made from a brass material.

11. The casting pattern of claim 6 further comprising a plurality of validation points which are formed on said casting pattern and which are disposed within a first plane relative to a centerline of said casting pattern.

12. The casting pattern of claim 11 wherein said plurality of validation points are formed on locations of said casting pattern which correspond to unmachined portions of said crankshaft.

* * * * *